US012202529B2

(12) United States Patent
Hart

(10) Patent No.: US 12,202,529 B2
(45) Date of Patent: Jan. 21, 2025

(54) COVER ASSEMBLIES FOR RAILROAD CARS

(71) Applicant: Gunderson LLC, Portland, OR (US)

(72) Inventor: Scott Hart, Milwaukie, OR (US)

(73) Assignee: Gunderson LLC, Lake Oswego, OR (US)

( * ) Notice: Subject to any disclaimer, the term of this patent is extended or adjusted under 35 U.S.C. 154(b) by 672 days.

(21) Appl. No.: 17/560,914

(22) Filed: Dec. 23, 2021

(65) Prior Publication Data

US 2023/0202535 A1 Jun. 29, 2023

(51) Int. Cl.

| | |
|---|---|
| ***B61D 17/16*** | (2006.01) |
| ***B65D 90/00*** | (2006.01) |
| *B61D 7/00* | (2006.01) |
| *B61D 7/16* | (2006.01) |
| *B61D 39/00* | (2006.01) |

(52) U.S. Cl.

CPC ..... *B61D 17/16* (2013.01); *B61D 5/08* (2013.01); *B61D 7/00* (2013.01); *B61D 7/16* (2013.01); *B61D 39/001* (2013.01); *B61D 39/006* (2013.01)

(58) Field of Classification Search

CPC . B61D 17/16; B61D 5/08; B61D 7/00; B61D 7/16; B61D 39/001; B61D 39/006

USPC ..... 105/377.11, 377.07; 292/256.5

See application file for complete search history.

(56) References Cited

U.S. PATENT DOCUMENTS

| | | | | | |
|---|---|---|---|---|---|
| 1,473,655 | A * | 11/1923 | Sweeley | B61D 17/16 | 292/265 |
| 2,160,260 | A * | 5/1939 | Dwyer | E05B 17/0025 | 292/265 |
| 2,816,683 | A * | 12/1957 | Miers | E05C 3/14 | 220/314 |
| 4,126,094 | A * | 11/1978 | Zimmerle | B61D 17/16 | 292/250 |
| 8,899,161 | B2 * | 12/2014 | Douglas | B61D 5/08 | 105/377.07 |
| 9,260,118 | B2 * | 2/2016 | Douglas | B61D 5/08 | |
| 9,499,178 | B2 * | 11/2016 | Douglas | B61D 5/08 | |
| 2013/0008340 | A1 * | 1/2013 | Douglas | B61D 5/08 | 105/377.07 |
| 2015/0083022 | A1 * | 3/2015 | Douglas | B61D 5/08 | 105/377.07 |

(Continued)

*Primary Examiner* — Zachary L Kuhfuss
(74) *Attorney, Agent, or Firm* — Chernoff, Vilhauer, McClung, & Stenzel, LLP

(57) ABSTRACT

Cover assemblies for railroad cars are disclosed. In some embodiments, the cover assemblies include a cover pivotably movable between closed and open positions. The cover assemblies additionally include a lid stop assembly including a release handle positioned adjacent to a cover handle and a first locking element operatively connected to the release handle. The lid stop assembly additionally includes a second locking element attached to, or formed with, the housing. The first locking element moves between a locking position in which the first locking element engages the second locking element to secure the cover in the open position, and a releasing position in which the first locking element is spaced from the second locking element allowing the cover to be moved from the open position toward the closed position. The release handle allowing the user to move the first locking element between the locking and releasing positions.

20 Claims, 8 Drawing Sheets

(56) References Cited

U.S. PATENT DOCUMENTS

| | | | | |
|---|---|---|---|---|
| 2016/0152246 | A1* | 6/2016 | Douglas | B61D 5/08 105/377.07 |
| 2016/0167680 | A1* | 6/2016 | Early | B61D 7/16 105/377.07 |
| 2017/0088149 | A1* | 3/2017 | Douglas | B61D 5/08 |
| 2017/0349188 | A1* | 12/2017 | Schmidt | B61D 5/08 |

* cited by examiner

COVER ASSEMBLIES FOR RAILROAD CARS

BACKGROUND OF THE INVENTION

The present application relates to railroad cars and, in particular, to cover assemblies for railroad cars.

Railroad cars generally include a tank body mounted on a pair of wheel trucks. Several valves and/or fittings of the railroad car may be enclosed in protective housings having pivotable covers or lids The covers may be large and heavy so it is important to prevent accident closure that is caused by, for example, wind gusts and that may result in injuries.

What is desired, then, is an improved cover assembly that secures the cover in an open position to prevent accidental closure.

SUMMARY OF THE INVENTION

A cover assembly as disclosed herein provides answers to some of the previously-mentioned shortcomings of previously known cover assemblies.

In one embodiment, the cover assembly includes a cover and a lid stop assembly to prevent closure of the cover.

In one embodiment, the lid stop assembly automatically engages and secures the cover when the cover is opened.

In one embodiment, the lid stop assembly includes one or more release rods that drops into corresponding recesses when the cover is opened.

In one embodiment, the lid stop assembly includes a release rod that rotates a pivoting latch out of a path of a fixed latch. The fixed latch may have a ramped portion that automatically engages the pivoting latch upon opening of the cover.

In one embodiment, the lid stop assembly includes a release rod that drops into a hole when the cover is opened. Interference between the rod and the edge of the hole prevents rotation of the cover. Pulling the release rod lifts the rod out of the hole providing clearance needed to allow rotation of the cover.

In one embodiment, the lid stop assembly includes a release rod that is connected to a swing plate, which interferes with a stopper preventing rotation of the cover. The release rod pulls the swing plate toward a parallel position to the cover allowing the cover to rotate to the closed position.

The release rod of one or more lid stop assemblies of the above embodiments may be gravity operated or may be assisted by an optional spring that aids axial movement of the rod.

The foregoing and other objectives and features will be more readily understood upon consideration of the following detailed description taken in conjunction with the accompanying drawings.

BRIEF DESCRIPTION OF THE SEVERAL DRAWINGS

DETAILED DESCRIPTION OF PREFERRED EMBODIMENTS

Figure 1:
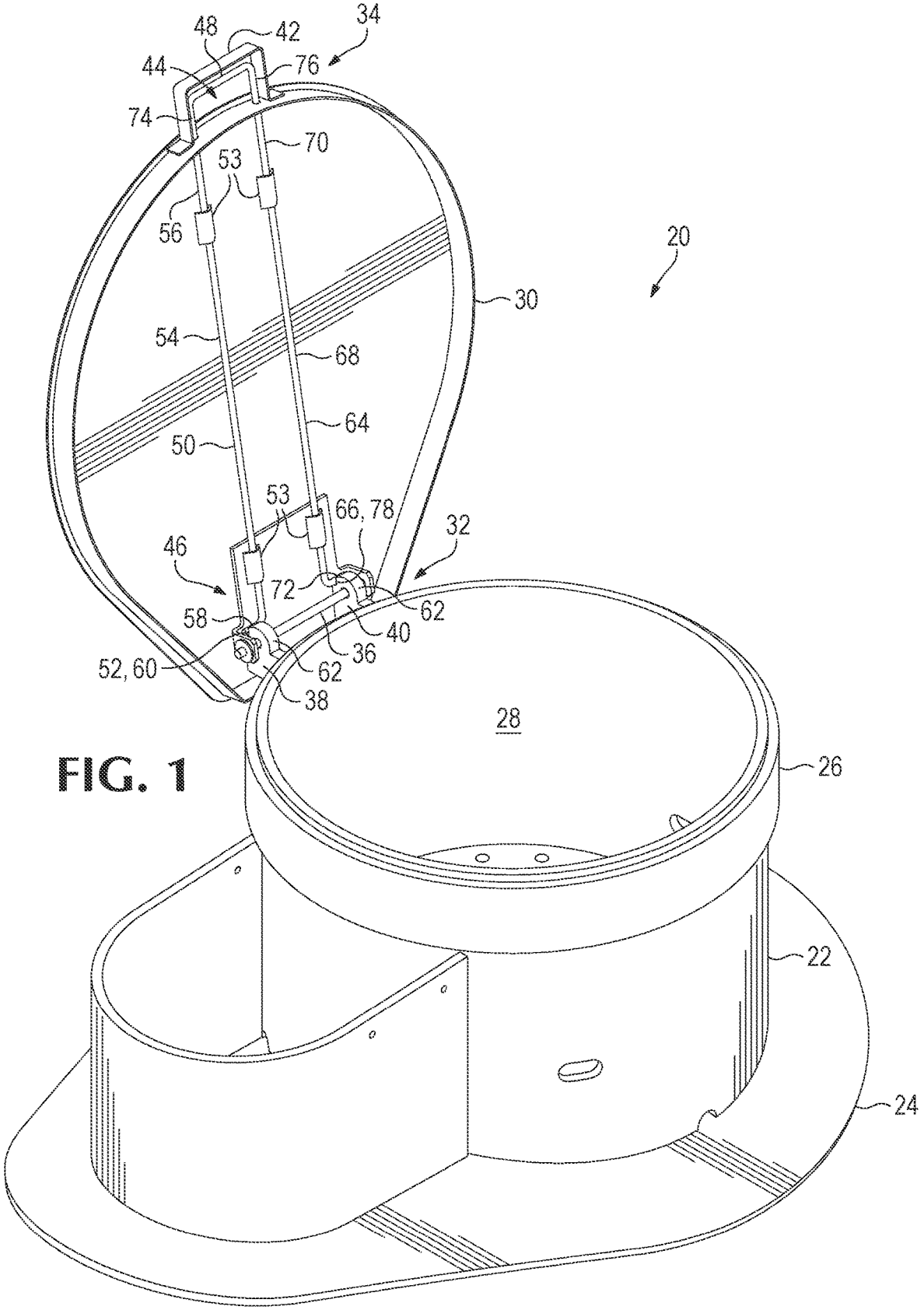
FIG. 1 is an isometric view of a cover assembly with a cover, showing an example of a lid stop assembly of the present disclosure.
Figure 2:
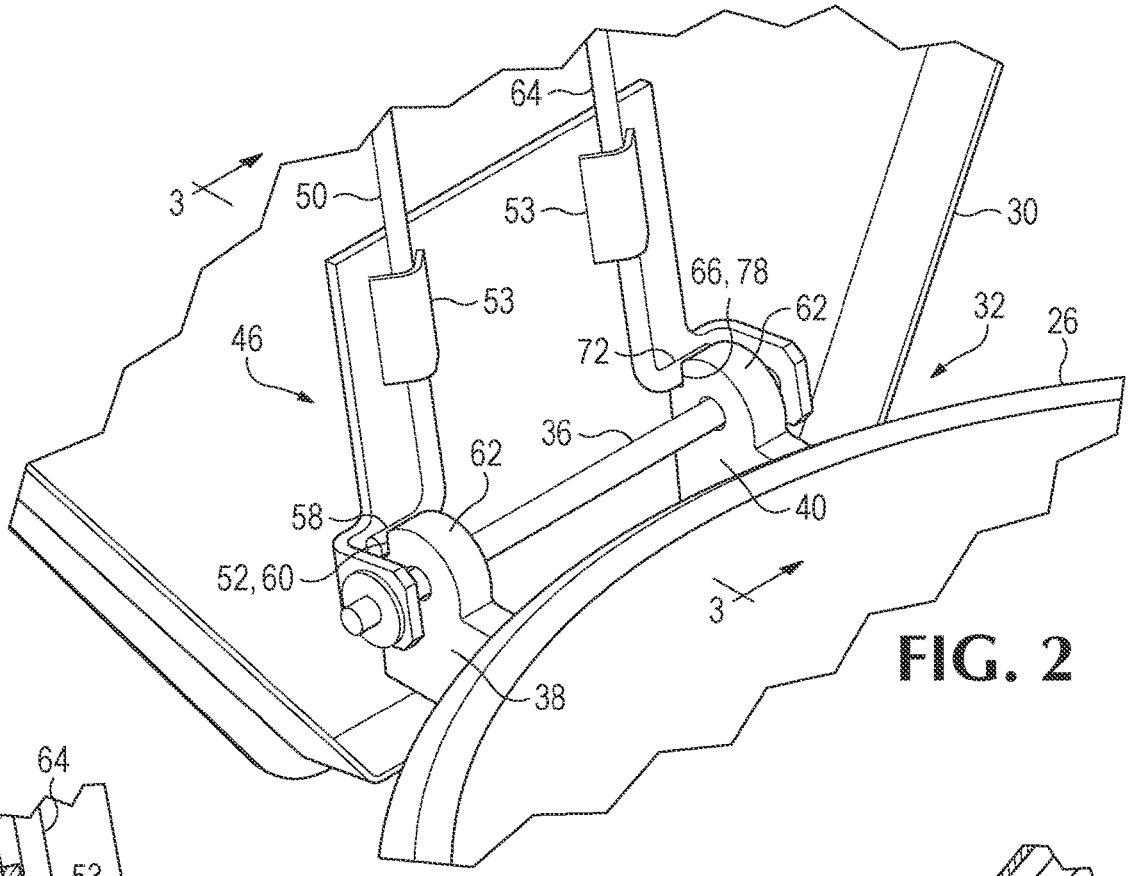
FIG. 2 is a partial view of the cover assembly of FIG. 1.
Figure 3:
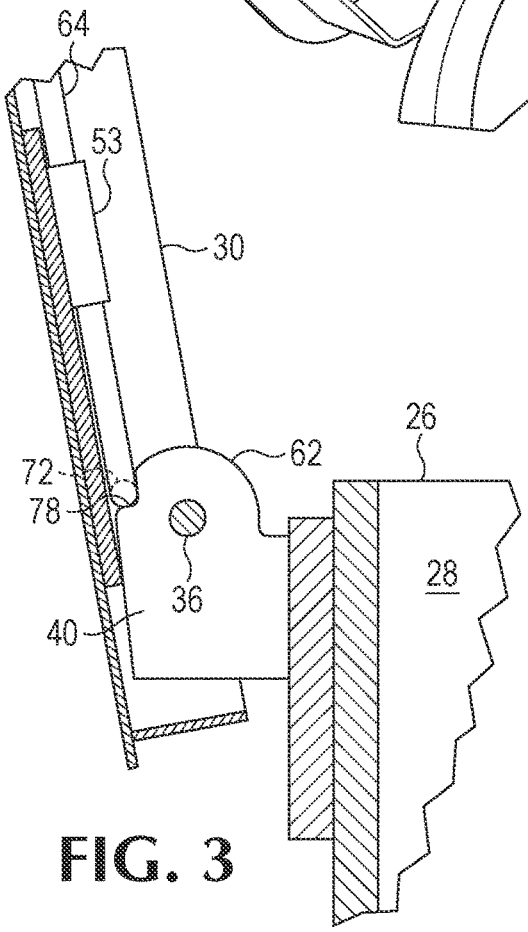
FIG. 3 is a sectional view of the cover assembly of FIG. 1 taken along lines 3-3 in FIG. 2, showing a cover in a fully open position and a locking element of the lid stop assembly in a locking position.
Figure 4:
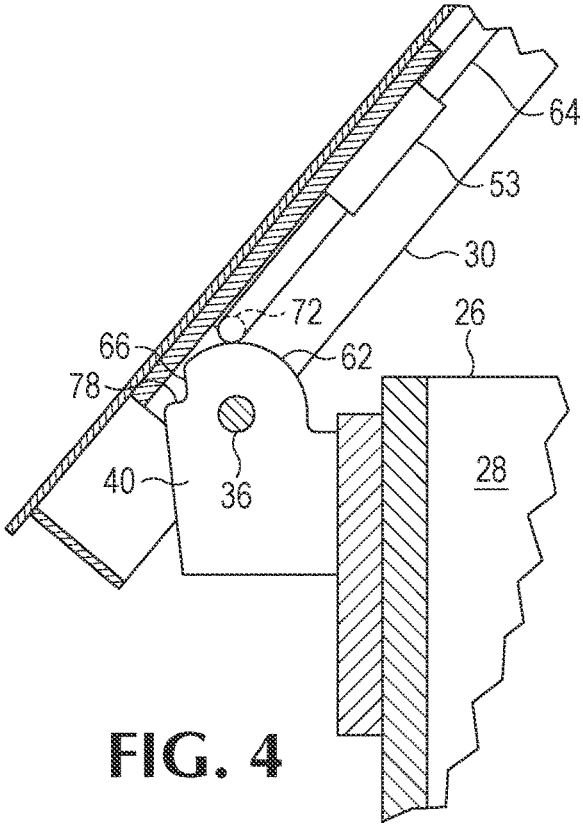
FIG. 4 is sectional view of the cover assembly of FIG. 3, showing a cover in a partially open position and the locking element in a releasing position.
Figure 5:
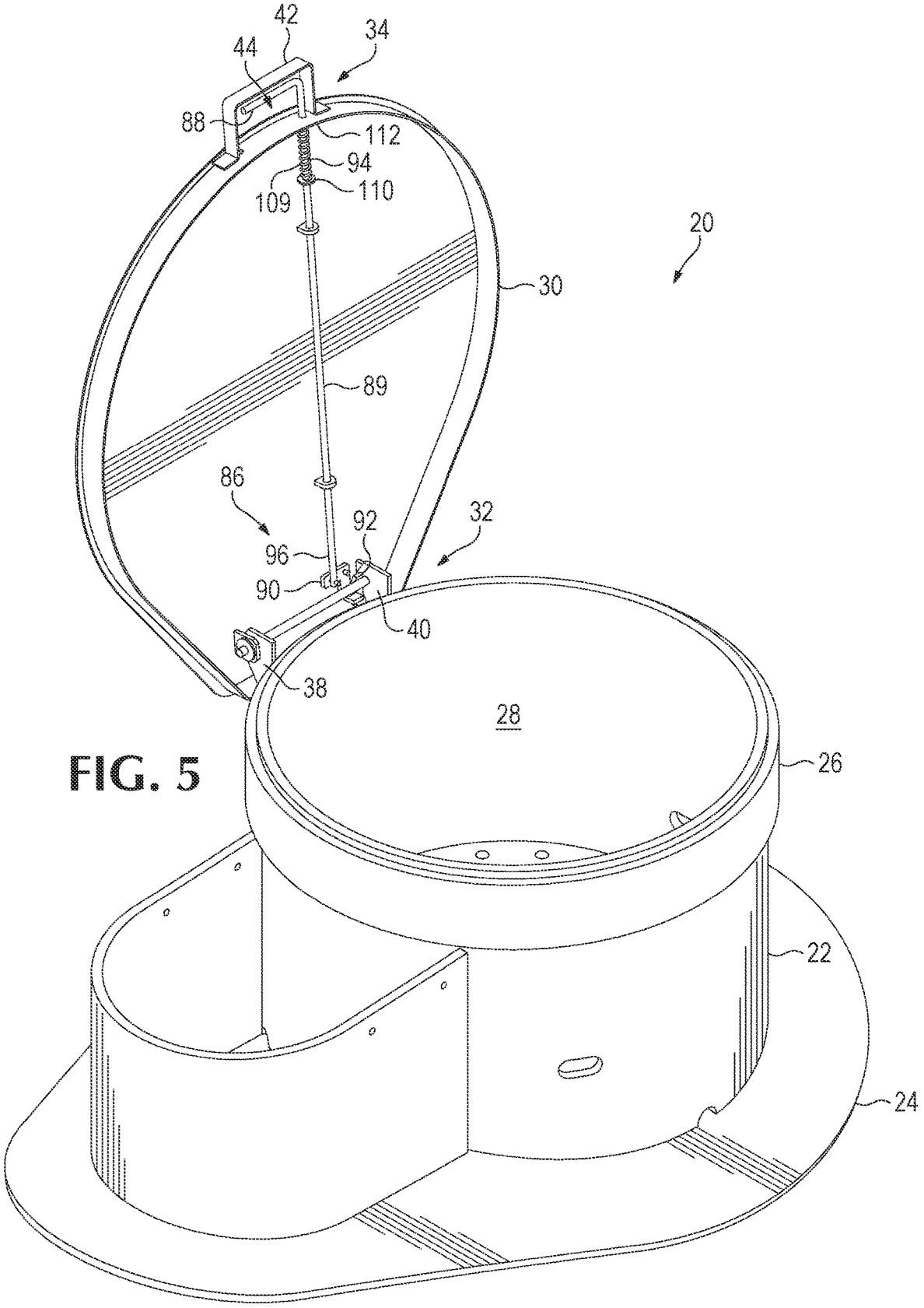
FIG. 5 is an isometric view of the cover assembly of FIG. 1, showing another example of a lid stop assembly of the present disclosure.
Figure 6:
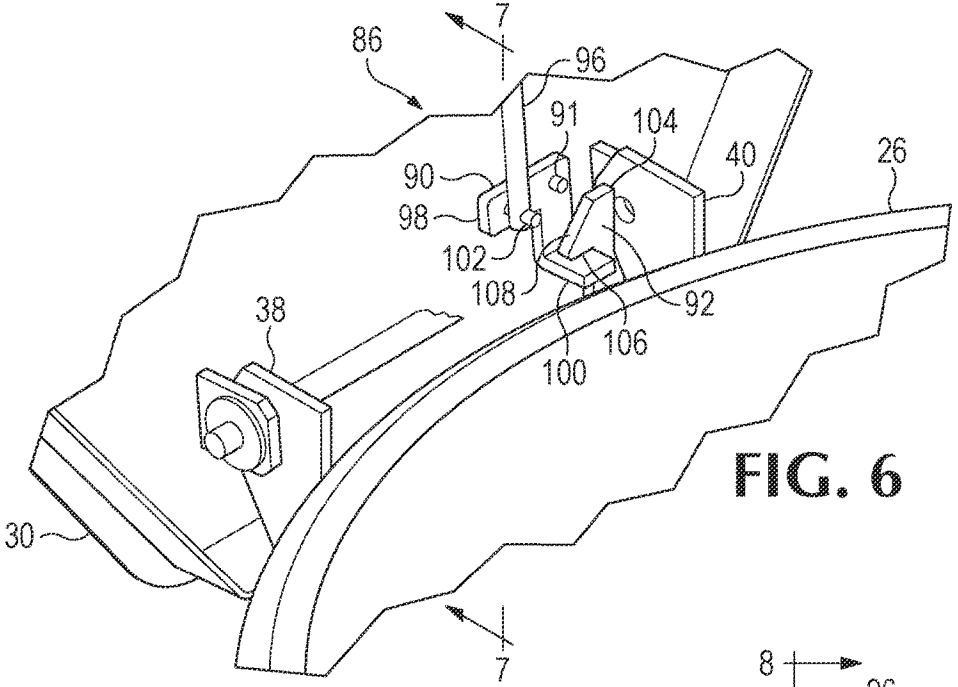
FIG. 6 is a partial view of the cover assembly of FIG. 5, showing a cover in a fully open position and a locking element of the lid stop assembly in a locking position.
Figure 7:
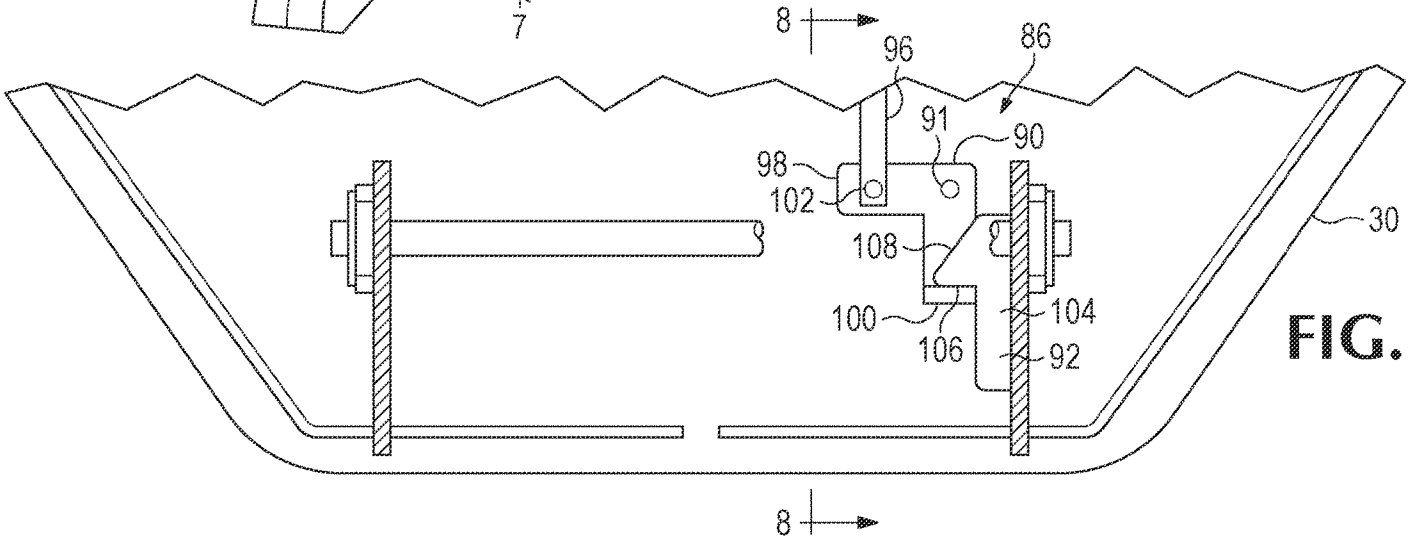
FIG. 7 is a sectional view of the cover assembly of FIG. 5 taken along lines 7-7 in FIG. 6, showing the cover in the fully open position and the locking element in the locking position.
Figure 8:
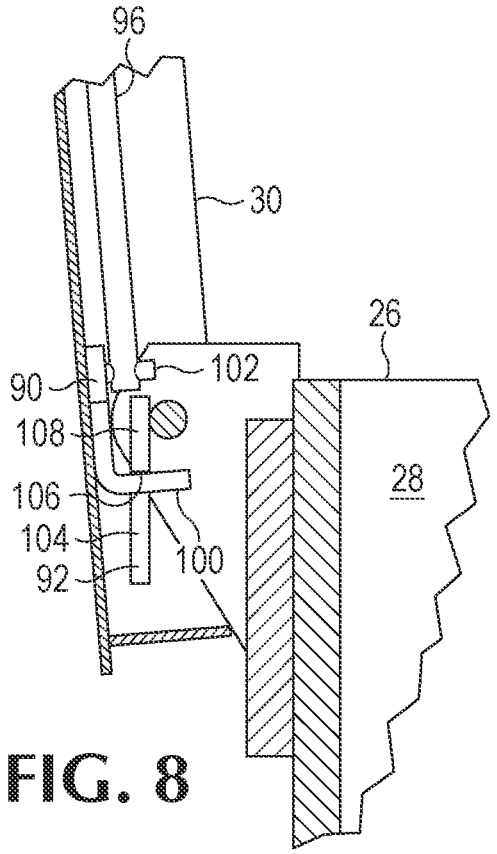
FIG. 8 is a sectional view of the cover assembly of FIG. 5 taken along lines 8-8 in FIG. 7, showing the cover in the fully open position and the locking element in the locking position.

Referring now to the drawings that form a portion of the disclosure herein, FIGS. 1-4 shows a cover assembly 20 incorporating a novel construction that secures a cover in an open position and prevents accidental closure. Cover assembly 20 is mounted on the top of a protective housing assembly 22, which is positioned on top of a car body 24. A housing 26 of protective housing assembly 22 defines an opening 28 for accessing the interior of housing 26, such as for accessing one or more valves and/or one or more fittings contained within the housing. In some examples, cover assembly 20 may be a manway assembly providing access to, for example, an interior of a tank car Cover assembly 20 includes a cover 30. The cover includes a hinge end portion 32 and a handle end portion 34, which are spaced from each other. A hinge assembly or hinge 36 pivotably attaches hinge end portion 32 of cover 30 to housing 26 to allow the cover to pivot among a plurality of positions. In the example shown in FIGS. 1-4, spaced projection elements 38 and 40 are attached to, or formed with, housing 26 and those projection elements pivotably or rotatably receive hinge 36. The plurality of positions of cover 30 includes a closed position and one or more open positions, such as a partially open position and a fully open position. In the closed position, the opening defined by housing 26 is generally covered or sealed by cover 30. In the partially open position, cover 30 is spaced from opening 28. In the completely open position, cover 30 is spaced from opening 28 sufficient enough to provide full or almost full access to the opening. In other words, the opening is generally uncovered, which may be at or toward the end of the range of positions provide by hinge 36. In some embodiments, cover 30 may be about or more than ninety degrees from opening 28 in the completely open position.

A cover handle 42 is attached to, or formed with, handle end portion 34 of cover 30. In the example shown in FIGS. 1-4, cover handle 42 is generally U-shaped defining an opening 44 between cover handle 42 and handle end portion 34 of cover 30. However, the cover handle may be any suitable shape(s), such as L-shaped, C-shaped, D-shaped, etc. Additionally, in the example shown in FIGS. 1-4, hinge end portion 32 and handle end portion 34 are opposed longitudinal end portions. However, other examples of cover 30 may have hinge end portion 32 and handle end portion 34 in any other suitable relationship, such as ninety degrees from each other.

Cover assembly 20 additionally includes a lid stop assembly 46 that secures cover 30 in an open position, such as the fully open position, to prevent accidental closure. Unless explicitly excluded, lid stop assembly 46 may additionally, or alternatively, include one or more components of one or more other lid stop assemblies of the present disclosure. In the example shown in FIGS. 1-4, lid stop assembly 46 includes a release handle 48, a first locking element 50, and a second locking element 52. Release handle 48 is movably or slidably connected to cover 30 and positioned adjacent to cover handle 42. In the example shown in FIGS. 1-4, release handle 48 is generally U-shaped. However, the release handle may be any suitable shape(s), such as L-shaped, C-shaped, D-shaped, etc. In some examples, release handle 48 may be positioned adjacent to cover handle 42 such that a user holding the cover handle with a hand can move the release handle with the same hand. For example, release handle 48 may be disposed between cover handle 42 and cover 30, such as disposed within opening 44 between cover handle 42 and handle end portion 34 of cover 30.

First locking element 50 is operable to move among a plurality of positions, including a locking position in which the first locking element contacts and/or engages second locking element 52 to secure and/or mechanically lock cover 30 in the open position, and a releasing position in which the first locking element is spaced from the second locking element allowing cover 30 to be moved from the open position toward the closed position. First locking element 50 is operatively connected to release handle 48 allowing a user to move the first locking element between the locking and releasing positions. For example, first locking element 50 is slidably connected to cover 30 via holders 53 attached to cover 30. In the example shown in FIGS. 1-4, the weight of the release handle and/or the first locking element urges the first locking element toward the locking position via gravitational forces. Alternatively, or additionally, lid stop assembly 46 further includes one or more springs (not shown) that urges the first locking element toward the locking position.

In the example shown in FIGS. 1-4, first locking element 50 is a first elongate bar 54 having opposed first and second longitudinal end portions 56 and 58. The first longitudinal end portion of first locking element 50 is attached to, or formed with, release handle 48. The second longitudinal end portion of first locking element 50 may be co-axial with first longitudinal end portion 56, may be perpendicular to the first longitudinal end portion, or may be any suitable angle relative to the first longitudinal end portion. In the example shown in FIGS. 1-4, second longitudinal end portion 58 is perpendicular to first longitudinal end portion 56 and/or is parallel to hinge 36.

Second locking element 52 is attached to, or formed with, housing 26. The second locking element is engaged and/or contacted by first locking element 50 in the locking position. In the example shown in FIGS. 1-4, second locking element 52 is a recess 60 on an outer surface 62 of one of projection elements 38 or 40. First locking element 50 is received in recess 60 when the first locking element is in the locking position, and is spaced and/or outside the recess when the first locking element is in the releasing position. Projection elements 38 and/or 40 may be shaped and/or sized to guide first locking element 50 toward recess 60 when cover 30 is moved toward the open position. For example, projection elements 38 and/or 40 may be shaped such that second longitudinal end portion 58 is in contact with outer surface 62 along at least a portion of travel of cover 30 as the cover is moved from the closed position toward the open position. The outer surface may maintain first locking element 50 in the releasing position when second longitudinal end portion 58 is in contact with outer surface 62. In the example shown in FIGS. 1-4, outer surface 62 is curvilinear and has the shape of a portion of the perimeter of a cylinder. However, outer surface 62 may be of other suitable shape(s).

In the example shown in FIGS. 1-4, lid stop assembly 46 additionally includes a third locking element 64. Similar to first locking element 50, third locking element 64 is operable to move among a plurality of positions, including a locking position in which the third locking element contacts and/or engages a fourth locking element 66 to secure cover 30 in the open position, and a releasing position in which the third locking element is spaced from the fourth locking element allowing cover 30 to be moved from the open position toward the closed position. Third locking element 64 is operatively connected to release handle 48 allowing a user to move the third locking element between the locking and releasing positions. For example, third locking element 64 is slidably connected to cover 30 via holders 53 attached to cover 30.

In the example shown in FIGS. 1-4, third locking element 64 is a second elongate bar 68 having opposed third and fourth longitudinal end portions 70 and 72. The third longitudinal end portion of third locking element 64 is attached to, or formed with, release handle 48, such as a portion different from where the first longitudinal end portion of the first locking element is attached to, or formed with, the release handle. In the example shown in FIGS. 1-4, the first longitudinal end portion of the first locking element and the third longitudinal end portion of the third locking element are attached to, or formed with, opposed longitudinal end portions 74 and 76 of release handle 48. The fourth longitudinal end portion of third locking element 64 may be co-axial with third longitudinal end portion 70, or may be perpendicular to the third longitudinal end portion. In the example shown in FIGS. 1-4, fourth longitudinal end portion 72 is perpendicular to third longitudinal end portion 70 and/or parallel to hinge 36.

Similar to second locking element 52, fourth locking element 66 is attached to, or formed with, housing 26. The fourth locking element is engaged and/or contacted by third locking element 64 in the locking position. In the example shown in FIGS. 1-4, fourth locking element 66 is a recess 78 on outer surface 62 of the other of projection elements 38 and 40, such as the projection element without recess 60. Third locking element 64 is received in recess 78 when the third locking element is in the locking position, and is spaced and/or outside that recess when the third locking element is in the releasing position. Projection elements 38 and/or 40 may be shaped and/or sized to guide third locking element 64 toward recess 78 when cover 30 is moved toward the open position. For example, projection elements 38 and/or 40 may be shaped such that fourth longitudinal end portion 72 is in contact with outer surface 62 along at least a portion of travel of cover 30 as the cover is moved from the closed position toward the open position. The outer surface may maintain third locking element 64 in the releasing position when fourth longitudinal end portion 72 is in contact with outer surface 62.

Referring to FIGS. 5-11, another example of lid stop assembly 46 is shown and is generally indicated at 86. Lid stop assembly 86 selectively secures cover 30 in an open position, such as the fully open position, to prevent accidental closure. Unless explicitly excluded, lid stop assembly 86 may additionally, or alternatively, include one or more components of one or more other lid stop assemblies of the present disclosure. In the example shown in FIGS. 5-11, lid stop assembly 86 includes a release handle 88, a follower element 89, a first locking element 90, and a second locking element 92. Release handle 88 is movably or slidably connected to cover 30 and positioned adjacent to cover handle 42. In the example shown in FIGS. 5-11, release handle 88 is generally L-shaped. However, the release handle may be any suitable shape(s), such as U-shaped, C-shaped, D-shaped, etc. In some examples, release handle 88 may be positioned adjacent to cover handle 42 such that a user holding the cover handle with a hand can move the release handle with the same hand. For example, release handle 88 may be disposed between cover handle 42 and cover 30, such as disposed within opening 44 between cover handle 42 and handle end portion 34 of cover 30.

Follower element 89 includes opposed longitudinal end portions 94 and 96. End portion 94 is attached to, or formed with, release handle 88. End portion 96 is attached to first locking element 90 as further discussed below.

Figure 9:
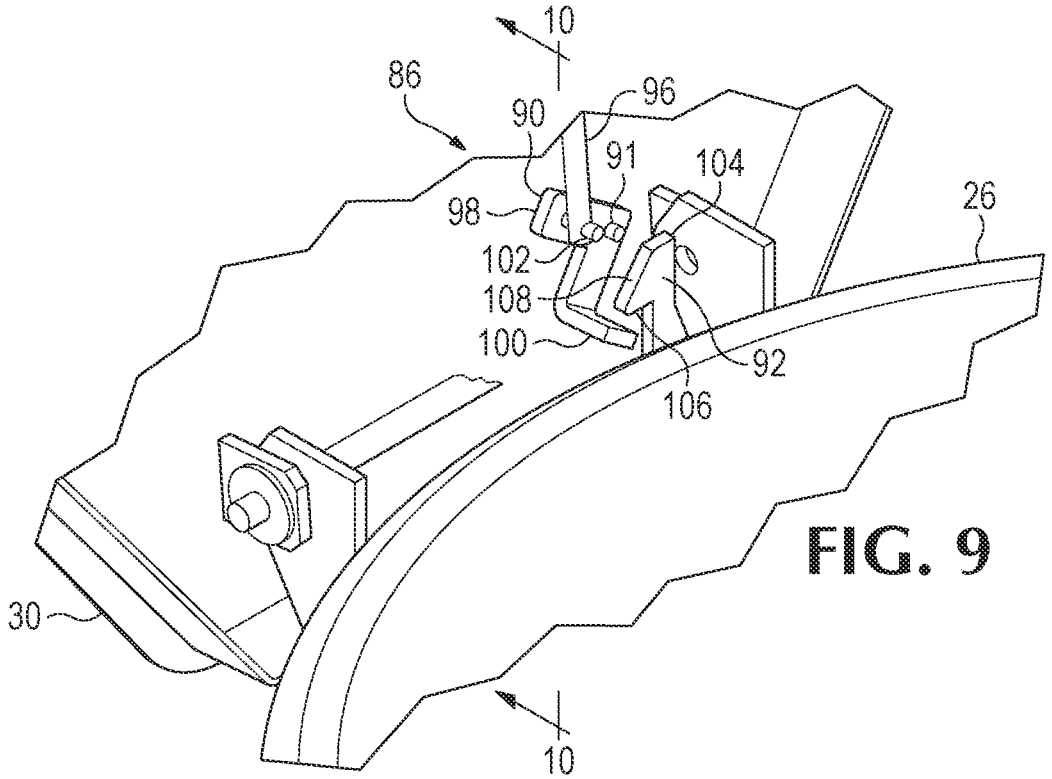
FIG. 9 is the partial view of FIG. 6, showing the cover in the fully open position and the locking element in a releasing position.
Figure 10:
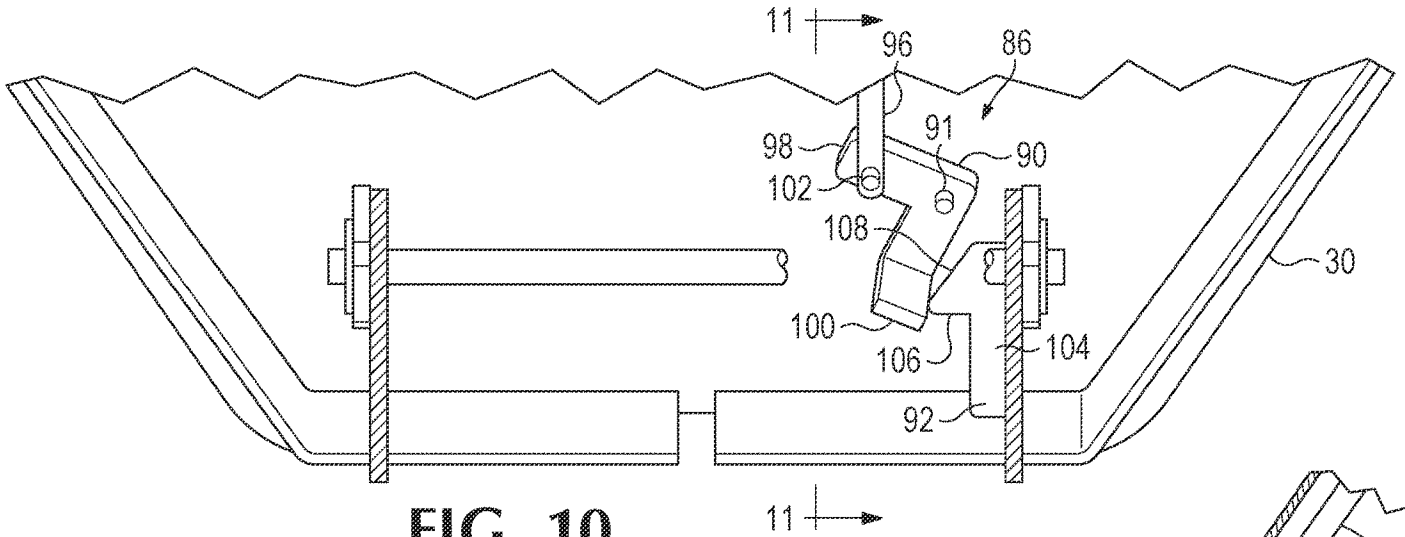
FIG. 10 is a sectional view of the cover assembly of FIG. 5 taken along lines 10-10 in FIG. 9, showing the cover in a partially open position and a locking element in a releasing position.
Figure 11:
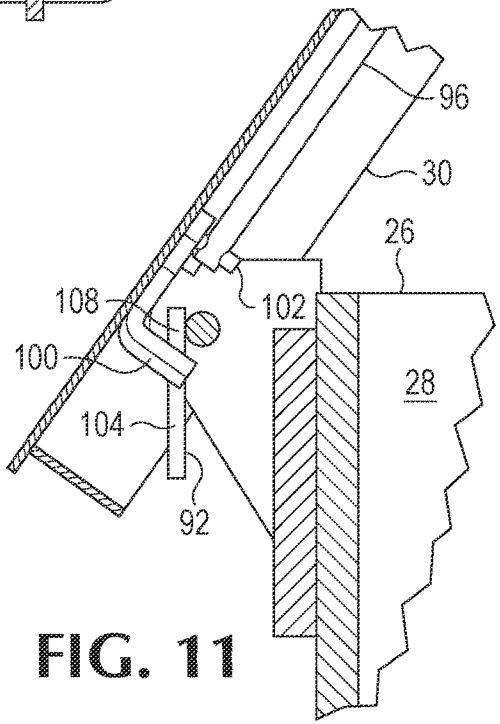
FIG. 11 is a sectional view of FIG. 8, showing the cover in a partially open position and the locking element in a releasing position.

First locking element 90 is pivotably connected to cover 30 (such as via pin 91) and is operable to move or pivot among a plurality of positions, including a locking position in which the first locking element contacts and/or engages second locking element 92 to secure and/or mechanically lock cover 30 in the open position (see FIGS. 6-8), and a releasing position in which the first locking element is spaced from the second locking element allowing cover 30 to be moved from the open position toward the closed position (see FIGS. 9-11). First locking element 90 includes a proximal end portion 98 and a distal end portion 100. Proximal end portion 98 is connected to release handle 88 via follower element 89 to allow a user to move the first locking element between the locking and releasing positions. In the example shown in FIGS. 5-11, a pin 102 attaches end portion 96 of follower element 89 to proximal end portion 98 of first locking element 90. The first locking element may be any suitable shape(s). In the example shown in FIGS. 5-11, first locking element 90 is a generally L-shaped but with the distal portion extending perpendicular of the remainder of the first locking element.

Second locking element 92 is attached to, or formed with, housing 26. In the example shown in FIGS. 5-11, second locking element 92 is attached to projection element 40. The second locking element is engaged and/or contacted by first locking element 90 in the locking position. In the example shown in FIGS. 5-11, second locking element 92 is a ledge or catch 104 having a planar face 106 that engages distal end portion 100 of first locking element 90 when the first locking element is in the locking position. Catch 104 additionally includes a sloped face 108 shaped and/or sized to guide distal end portion 100 of first locking element 90 toward planar face 106 when cover 30 is moved toward the open position. For example, catch 104 and/or planar face 106 may be shaped and/or sized such that distal end portion 100 is in contact with planar face 106 along at least a portion of travel of cover 30 as the cover is moved from the closed position toward the open position. The planar surface may maintain first locking element 90 in the releasing position when distal end portion 100 is in contact with planar face 106.

In the example shown in FIGS. 5-11, lid stop assembly 86 includes at least one spring 109 that urges first locking element 90 toward the locking position. The spring is disposed between a flange 110 of follower element 89 and an inner surface 112 of cover 30 to urge the release handle and the follower element toward the first locking element, which urges the first locking element toward the locking position. In other examples, lid stop assembly 86 may exclude spring 109. In those examples, the weight of the release handle and the follower element may urge the first locking element to the locking position.

Figure 12:
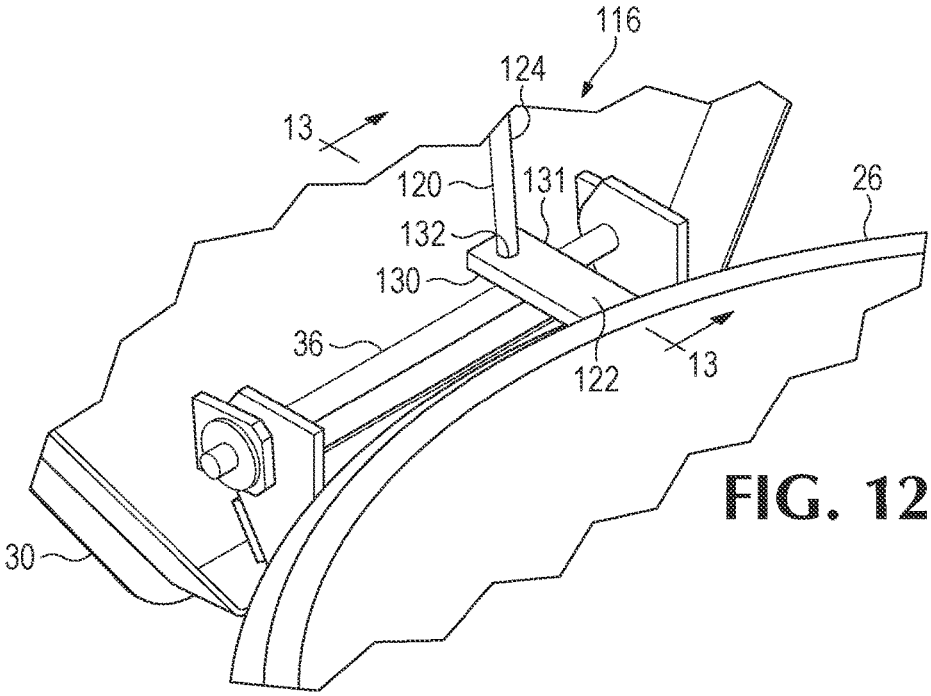
FIG. 12 is the partial view of FIGS. 6 and 9, showing an additional example of a lid stop assembly of the present disclosure.
Figure 13:
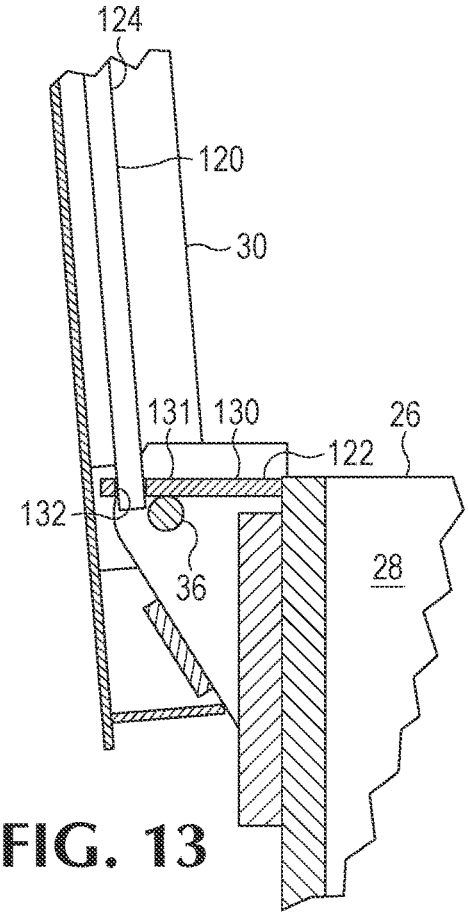
FIG. 13 is a sectional view of the lid stop assembly of FIG. 12 taken along lines 13-13 in FIG. 12, showing the cover in a fully open position and a locking element of the lid stop assembly in a locking position.
Figure 14:
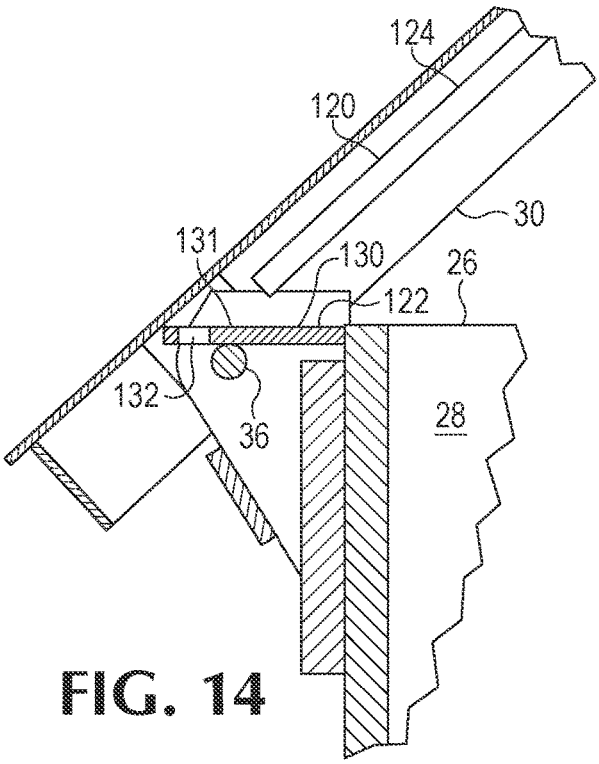
FIG. 14 is the sectional view of FIG. 13, showing the cover in a partially open position and the locking element in a releasing position.

Referring to FIGS. 12-14, another example of lid stop assembly 46 is shown and is generally indicated at 116. Lid stop assembly 116 selectively secures cover 30 in an open position, such as the fully open position, to prevent accidental closure. Unless explicitly excluded, lid stop assembly 116 may additionally, or alternatively, include one or more components of one or more other lid stop assemblies of the present disclosure. Lid stop assembly 116 includes a release handle (e.g., 48 in FIG. 1 or 88 in FIG. 5), a first locking element 120, and a second locking element 122.

First locking element 120 is operable to move among a plurality of positions, including a locking position in which the first locking element contacts and/or engages second locking element 122 to secure and/or mechanically lock cover 30 in the open position, and a releasing position in which the first locking element is spaced from the second locking element allowing cover 30 to be moved from the open position toward the closed position. First locking element 120 is operatively connected to the release handle allowing a user to move the first locking element between the locking and releasing positions. For example, first locking element 120 is slidably connected to cover 30 via holders 53 attached to cover 30 (see FIG. 5). The weight of the release handle and/or first locking element urges the first locking element toward the locking position via gravitational forces. Alternatively, or additionally, lid stop assembly 116 further includes one or more springs (109 in FIG. 5) that urges the first locking element toward the locking position.

In the example shown in FIGS. 12-14, first locking element 120 is a first elongate bar 124 having opposed first and second longitudinal end portions. The first longitudinal end portion of first locking element 120 is attached to, or formed with, the release handle (e.g., 48 in FIG. 1 or 88 in FIG. 5). The second longitudinal end portion of first locking element 120 may be co-axial with the first longitudinal end portion, may be perpendicular to the first longitudinal end portion, or may be any suitable angle relative to the first longitudinal end portion. In the example shown in FIGS. 12-14, the second longitudinal end portion is co-axial with the first longitudinal end portion.

Second locking element 122 is attached to, or formed with, housing 26. The second locking element is engaged and/or contacted by first locking element 120 in the locking position. In the example shown in FIGS. 12-14, second locking element 122 is a plate 130 attached to, or formed with, housing 26. Plate 130 may be perpendicular to hinge 36 or any other suitable orientation relative to hinge 36. Plate 130 includes a plate base 131 and at least one aperture 132 sized to receive the second longitudinal end portion of first locking element 120 when the first locking element is in the locking position.

Figure 15:
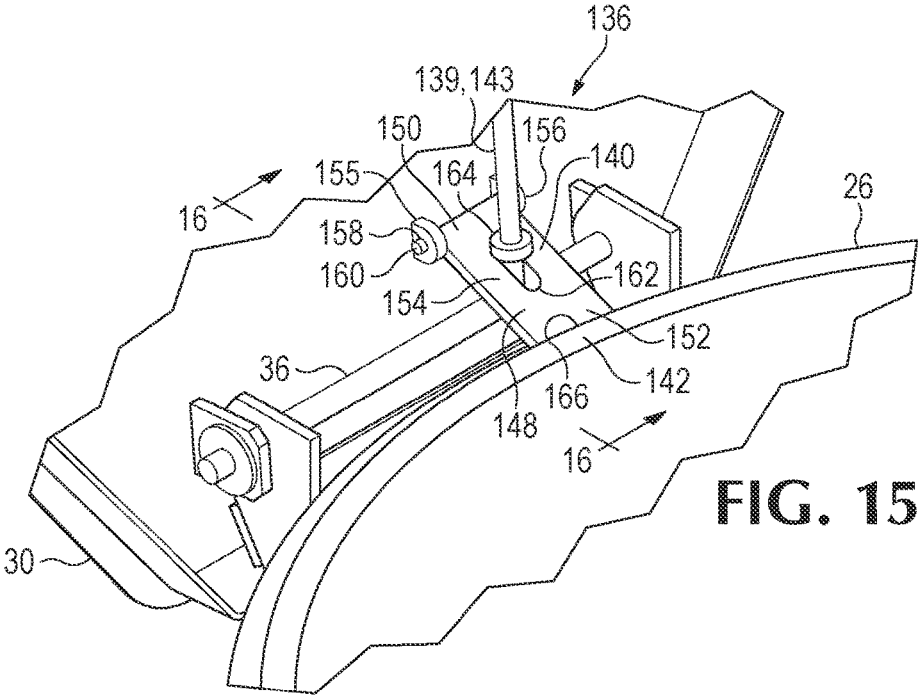
FIG. 15 is the partial view of FIGS. 6, 9, and 12, showing a further example of a lid stop assembly of the present disclosure.
Figure 16:
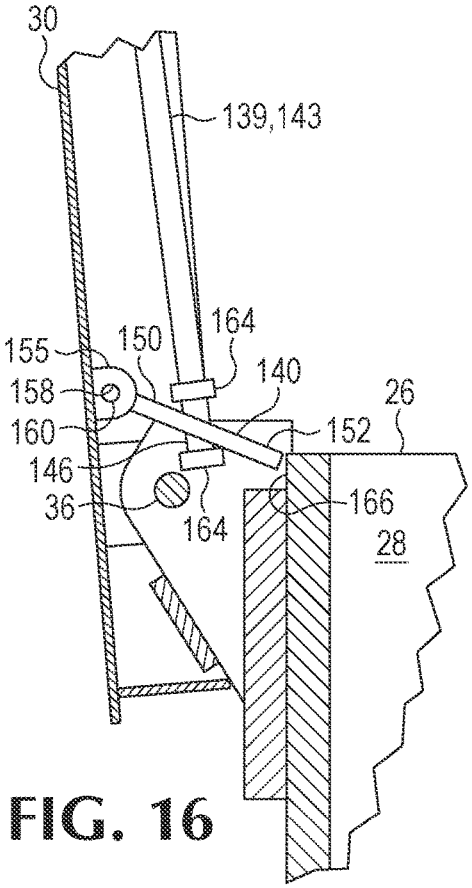
FIG. 16 is a sectional view of the lid stop assembly of FIG. 15 taken along lines 16-16 in FIG. 15, showing the cover in a fully open position and a locking element of the lid stop assembly in a locking position.
Figure 17:
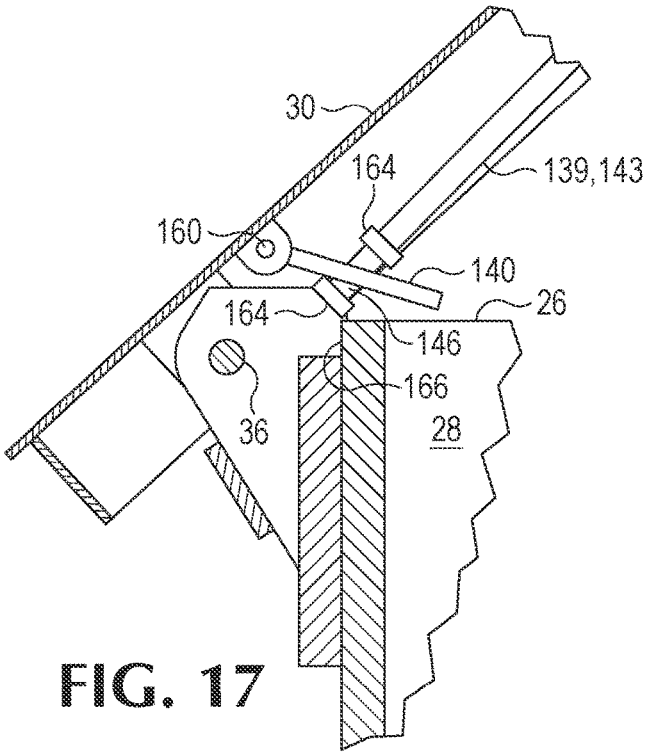
FIG. 17 is the sectional view of FIG. 16, showing the cover in a partially open position and the locking element in a releasing position.

Referring to FIGS. 15-17, another example of lid stop assembly 46 is shown and is generally indicated at 136. Lid stop assembly 136 selectively secures cover 30 in an open position, such as the fully open position, to prevent accidental closure. Unless explicitly excluded, lid stop assembly 136 may additionally, or alternatively, include one or more components of one or more other lid stop assemblies of the present disclosure. In the example shown in FIGS. 15-17, lid stop assembly 136 includes a release handle (e.g., 48 in FIG. 1 or 88 in FIG. 5), a follower element 139, a first locking element 140, and a second locking element 142.

Follower element 139 includes an elongate base 143 having opposed first and second longitudinal end portions. The first longitudinal end portion is attached to, or formed with, the release handle. The second longitudinal end portion is attached to first locking element 140 as further discussed below.

First locking element 140 is pivotably connected to cover 30 and is operable to move or pivot among a plurality of positions, including a locking position in which the first locking element contacts and/or engages second locking element 142 to secure and/or mechanically lock cover 30 in the open position (see FIGS. 15-16), and a releasing position in which the first locking element is spaced from the second locking element allowing cover 30 to be moved from the open position toward the closed position (see FIG. 17).

First locking element 140 includes a locking base 148 having a proximal end portion 150, a distal end portion 152, and a central portion 154 disposed between proximal end portion 150 and distal end portion 152. In the example shown in FIGS. 15-17, proximal end portion 150 is pivotably connected to cover 30 via cover projection elements 155 and 156 having holes 158 and pins 160 received in those apertures. Central portion 154 includes an opening or aperture 162. End portion 146 of follower element 139 is received in aperture 162. Follower element 139 includes spaced flanges 164 that are attached to, or formed with, elongate base 143 and that sized and/or shaped to maintain the follower element in aperture 162.

Second locking element 142 is attached to, or formed with, housing 26. In the example shown in FIGS. 5-11, second locking element 142 is an external or outer wall portion 166 of housing 26. The second locking element is engaged and/or contacted by first locking element 90 in the locking position. Although second locking element 142 is shown as external or outer wall portion 166 of housing 26, second locking element 142 may alternatively be a wall or other structure attached to housing 26.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A cover assembly for a railroad car having a housing that defines an opening, the cover assembly comprising:
- a cover having spaced first and second end portions;
- a cover handle attached to, or formed with, the first end portion of the cover
- a hinge attaching the second end portion to the housing so that the cover pivots among a plurality of positions including a closed position in which the opening is generally covered by the cover, and an open position in which the opening is generally uncovered; and
- a lid stop assembly, including:
  - a release handle that is slidably connected to the cover and positioned adjacent to the cover handle,
  - first locking element operatively connected to the release handle, and
  - a second locking element attached to, or formed with, the housing, wherein the first locking element moves between a locking position in which the first locking element engages the second locking element to secure the cover in the open position, and a releasing position in which the first locking element is spaced from the second locking element allowing the cover to be moved from the open position toward the closed position, the release handle allowing the user to move the first locking element between the locking and releasing positions.

2. The cover assembly of claim 1, wherein the release handle is positioned adjacent to the cover handle such that a user holding the cover handle with a hand can slidably move the release handle with that hand.

3. The cover of assembly of claim 2, wherein the release handle is disposed between the cover handle and the cover.

4. The cover assembly of claim 1, wherein the first locking element is a first elongate bar having opposed first and second longitudinal end portions, the first longitudinal end portion is attached to, or formed with, the release handle.

5. The cover assembly of claim 4, further comprising spaced first and second projection elements attached to, or formed with, the housing, the first and second spaced projection elements rotatably receiving the hinge.

6. The cover assembly of claim 5, wherein each of the first and second spaced projection elements includes an outer surface and the second locking element is a recess on the outer surface of one of the first or second spaced projection elements, the second longitudinal end portion of the first elongate bar being received in the recess when the first elongate bar is in the locking position.

7. The cover assembly of claim 6, wherein the one of the first or second spaced projection elements is shaped such that the second longitudinal end portion of the first elongate bar is in contact with the outer surface along at least a portion of travel of the cover as the cover is moved from closed position toward the open position, the outer surface maintaining the first elongate bar in the releasing position when the first elongate bar is in contact with the outer surface.

8. The cover assembly of claim 6, wherein the second longitudinal end portion of the first elongate bar is parallel to the hinge.

9. The cover assembly of claim 6, further comprising a third locking element attached to, or formed with, the release handle, the third locking element being spaced from the first locking element.

10. The cover assembly of claim 9, wherein the third locking element is a second elongate bar having opposed third and fourth longitudinal end portions, the third longitudinal end portion is attached to, or formed with, a portion of the release handle different from the first locking element.

11. The cover assembly of claim 10, wherein the other of the first or second spaced projection elements includes a recess, and wherein each of the second and the fourth longitudinal end portions is received in a corresponding recess of the first and second spaced projection elements.

12. The cover assembly of claim 10, wherein the release handle includes opposed first and second longitudinal end portions, the first locking element being attached to, or formed with, the first longitudinal end portion of the release handle and the third locking element being attached to, or formed with, the second longitudinal end portion of the release handle.

13. The cover assembly of claim 4, further comprising a plate attached to the housing, wherein the second locking element is an aperture on the plate sized to receive the second longitudinal end portion of the elongate bar when the first locking element is in the locking position.

14. The cover assembly of claim 1, further comprising a follower element attached to, or formed with, the release handle, wherein the first locking element includes first and second portions, the follower element being attached to the first portion of the first locking element, the first locking element being pivotably connected to the cover, and wherein the second portion of the first locking element engages the second locking element when the first locking element is in the locking position.

15. The cover assembly of claim 14, wherein the first and second portions of the first locking element are opposed end portions, and the first portion is attached to the follower element.

16. The cover assembly of claim 15, wherein the second locking element is a catch having a planar face that engages the second end portion of the first locking element when the locking element is in the locking position.

17. The cover assembly of claim 16, wherein the catch includes a sloped face separate from the planar face, the catch being sized such that the second longitudinal end portion of the first locking element is in contact with the sloped face along at least a portion of travel of the cover as the cover is moved from closed position toward the open position, wherein the sloped face maintains the first locking element in the releasing position when the first locking element is in contact with the sloped face.

18. The cover assembly of claim 14, wherein the first portion is a longitudinal end portion of the first locking element and the second portion is a central portion of the first locking element, the central portion including an aperture that receives the follower element, and the follower element having an elongate base and spaced flanges attached to, or formed with, the elongate base to retain the elongate base in the aperture.

19. The cover assembly of claim 18, wherein the second locking element is an outer wall of the housing.

20. The cover assembly of claim 1, further comprising at least one spring that urges the first locking element toward the locking position.

* * * * *